US006638030B2

(12) United States Patent
Nishimura et al.

(10) Patent No.: US 6,638,030 B2
(45) Date of Patent: Oct. 28, 2003

(54) OIL FREE SCREW COMPRESSOR

(75) Inventors: Hitoshi Nishimura, Shimizu (JP); Akira Suzuki, Shimizu (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/224,657

(22) Filed: Aug. 21, 2002

(65) Prior Publication Data

US 2003/0012674 A1 Jan. 16, 2003

Related U.S. Application Data

(63) Continuation of application No. 09/828,199, filed on Apr. 9, 2001, now Pat. No. 6,471,492, which is a continuation of application No. 09/391,088, filed on Sep. 16, 1999, now Pat. No. 6,287,088.

(30) Foreign Application Priority Data

Sep. 17, 1998 (JP) ..... 10-262714

(51) Int. Cl.[7] ..... F04B 49/00

(52) U.S. Cl. ..... 417/297; 418/201.1; 417/410.4; 417/372

(58) Field of Search ..... 417/297, 410.4, 417/372; 184/6.22, 6.16; 418/201.1

(56) References Cited

U.S. PATENT DOCUMENTS

| | | | | |
|---|---|---|---|---|
| 4,767,284 A | * | 8/1988 | Shiinoki et al. | 417/312 |
| 4,770,615 A | | 9/1988 | Fujiwara et al. | 418/15 |
| 4,984,974 A | * | 1/1991 | Naya et al. | 418/87 |
| 5,246,349 A | | 9/1993 | Hartog | 417/371 |
| 5,263,832 A | | 11/1993 | Yamaguchi | 418/9 |
| 5,295,798 A | * | 3/1994 | Maruyama et al. | 418/201.1 |
| 5,401,149 A | | 3/1995 | Tsuru et al. | 418/178 |
| 5,454,700 A | * | 10/1995 | Iguchi et al. | 418/201.1 |
| 5,836,754 A | * | 11/1998 | Ozaki et al. | 418/201.3 |
| 5,910,001 A | * | 6/1999 | Takahashi et al. | 418/1 |
| 5,938,420 A | * | 8/1999 | Teraoka | 418/201.1 |
| 6,461,112 B1 | * | 10/2002 | Ohta et al. | 417/26 |

FOREIGN PATENT DOCUMENTS

| | | |
|---|---|---|
| JP | 5993989 | 5/1984 |
| JP | 3151592 | 6/1991 |
| JP | 4365985 | 12/1992 |
| JP | 6346881 | 12/1994 |

OTHER PUBLICATIONS

Shigley, Joseph E., Mechanical Engineering Design, McGrawHill, NY, NY 1977.

* cited by examiner

*Primary Examiner*—Charles G. Freay
*Assistant Examiner*—William H. Rodriguez
(74) *Attorney, Agent, or Firm*—Antonelli, Terry, Stout & Kraus, LLP

(57) ABSTRACT

A screw compressor includes a compressor main body, a male rotor having a screw-like male tooth shape and a female rotor having a screw-like female tooth shape meshing with the screw-like male tooth shape or the male rotor. The male and female motors are provided within the compressor main body. A motor casing is operably connected to the compressor main body, and a high speed electric motor provided within the motor casing. The motor includes a motor rotor, a motor stator and a motor shaft for driving at least one of the male and female rotors. A speed ratio of the motor shaft and the at least one of the male and female rotors driven by the motor shaft is in a range of 2:1 to 1:2.

17 Claims, 8 Drawing Sheets

OIL FREE SCREW COMPRESSOR

This is a continuation of application Ser. No. 09/828,199, filed Apr. 9, 2001 (now U.S. Pat. No. 6,471,492), which is a continuation of application Ser. No. 09/391,088 (now U.S. Pat. No. 6,287,088), filed Sep. 16, 1999.

BACKGROUND OF THE INVENTION

The present invention relates to an oil free screw compressor which synchronously rotates a pair of screw rotors without being in contact, and more particularly to an oil free screw compressor preferable for being driven by a high speed motor.

A conventional oil free screw compressor is, for example, as described in Japanese Patent Unexamined Publication No. 6-346881, structured such as to increase a rotational speed of a motor by using a belt and a gear so as to rotate a screw compressor main body. Further, in Japanese Patent Unexamined Publication No. 3-151592, there is described an embodiment of connecting a speed increasing gear apparatus receiving a speed increasing gear within a casing to a rotor shaft having a screw gear formed thereon via a coupling.

In this case, in the screw compressor, in addition to an operation control such as a load, an unload and the like, a capacity control for controlling an opening and closing operation of a suction throttling valve in accordance with a consumption requirement in the demand side is performed. As an example of the capacity control, there is described in Japanese Patent Unexamined Publication No. 59-93989 a structure in which a valve plate for the suction throttling valve is mounted to a front end of an air cylinder operated by a pressure of the compressor itself and an amount of a suction air is adjusted at two stages by moving the valve plate.

Here, the compressor described in Japanese Patent Unexamined Publication No. 6-346881 mentioned above requires a lot of parts such as a bearing for rotating and supporting a speed increasing gear, a rotary shaft for mounting the speed increasing gear, a belt and a pulley for transmitting a power having an increased speed and the like in addition to a gear case for receiving the speed increasing gear, thereby causing an increase of a cost for the compressor. Further, in this compressor, an electric motor for driving the screw rotor is enlarged, and accordingly, the compressor is insufficient in view of making small-sized a whole of the compressor unit including a stand for fixing the electric motor.

Further, in the compressor described in Japanese Patent Unexamined Publication No. 3-151592, since the speed increase is not performed by the belt, a speed increasing rate in the speed increasing gear is increased, and a gear case for receiving the speed increasing gear is enlarged. Then, in order to make the compressor as series of widely used compressors, it is necessary to combine various kinds of compressor main bodies and speed increasing gear apparatuses, thereby causing an increase of a cost in view of preparing various kinds of compressors.

Still further, in the compressor described in Japanese Patent Unexamined Publication No. 59-93989, since an air for operating a suction throttling valve is supplied to an air cylinder at every time when a line pressure is changed, a three-way electromagnetic valve is connected to an air cylinder and a supply hole for the operating air in the air cylinder is switched by the three-way electromagnetic valve. As mentioned above, since it is necessary to provide with the three-way electromagnetic valve, a structure of a flow rate control system becomes complex as well as the compressor becomes expensive. Further, in order to cancel an unloading at a time of start, a plurality of three-way electromagnetic valves are required, so that a structure of a capacity control apparatus becomes complex. In any one of the compressors mentioned above, a certain degree of consideration is given to making the compressor compact, however, a more compact structure is desired.

SUMMARY OF THE INVENTION

The present invention is made in view of the problems mentioned above in the conventional arts, and an object of the present invention is to make a structure of a compressor unit simple. Another object of the present invention is to making a compressor unit compact so as to realize a compressor unit having a great freedom for placing. The other object of the present invention is to realize an inexpensive compressor unit having a reduced cost. The other object of the present invention is to make elements in a side of a compressor main body common with elements in a side of an electric motor so as to realize a compressor unit having a high reliability.

In order to achieve the objects mentioned above, in accordance with the present invention, there is provided an oil free screw compressor comprising a motor shaft to which a motor rotor is mounted, a motor casing for holding a motor stator arranged in opposite to the motor rotor, a male rotor in which a screw-like male tooth shape is formed, a female rotor in which a screw-like female tooth shape is formed, and a casing for receiving the male rotor and the female rotor. In the above structure, a first feature is that a rotational speed of the motor is made equal to a rotational speed of at least one of the male rotor and the female rotor.

In this structure, the rotational shaft formed in any one of the male rotor and the female rotor and the motor shaft may be an integral rotary shaft. Further, the structure may be made such that a first gear is provided in a side of one end of any one of the male rotor and the female rotor, a second gear meshing with the first gear is provided in a side of one end of the motor shaft, and a ratio of a number of teeth between the first gear and the second gear may be set to be substantially one to one.

In order to achieve the objects mentioned above, a second feature of the present invention is that a rotational speed of a high frequency electric motor is made equal to a rotational speed of at least one of the male rotor and the female rotor.

Preferably, the structure is made such that a first gear is provided in a side of one end of any one of the male rotor and the female rotor, a second gear meshing with the first gear is provided in a side of one end of the high frequency electric motor, and a ratio of a number of teeth between the first gear and the second gear is set to be one to one. Further, the structure is preferably made such that a roller bearing for rotatably supporting the male rotor and the female rotor is provided in each of the rotors, and a roller bearing having the same size as that of the roller bearing is provided in the high frequency electric motor. More preferably, the structure is made such that a screw seal for sealing a lubricating oil supplied to the roller bearing for supporting the male rotor and the female rotor is provided in each of the rotors, a screw seal for sealing a lubricating oil supplied to the roller bearing provided in the high frequency electric motor is provided, and sizes of the screw seals are made equal to each other.

In order to achieve the objects mentioned above, a third feature of the present invention is that a high speed motor driven by a high frequency inverter is connected to a suction side of the compressor main body, the high speed motor has a motor shaft in which the motor rotor is formed, a third bearing for rotating and supporting the motor shaft and a second shaft sealing apparatus for preventing a lubricating oil for lubricating the third bearing from entering within the high speed motor, the first, second and third bearings are made the same with respect to each other, and the first shaft sealing apparatus and the second shaft sealing apparatus are made the same.

It is desirable to fit the first gear to the shaft end of the rotor, fit the second gear meshing with the first gear to the shaft end of the high speed motor in a load side, and to set the ratio of the number of the teeth between the first and second gears to a range from two to one to one to two. Further, it is desirable to directly connect the shaft end of the male rotor provided in the compressor main body to the shaft end in the load side of the high speed motor by means of a coupling or a spline. Further, it is desirable to provide with bearings supporting the male rotor and positioned at both end portions of the rotor, a motor rotor positioned between one of the bearings and a gear groove portion of the male rotor and fitted to the male rotor, a motor stator opposing to the motor rotor and a motor casing for holding the motor stator, and connect the motor casing to the suction side of the casing.

More preferably, the structure is made such that the compressor main body and the high speed motor are integrally formed, a common table which receives an after cooler for cooling a compressed air compressed in the compressor main body, a pre-cooler and an oil cooler for cooling a lubricating oil is provided, and the integrated compressor main body and high speed motor are arranged above the common table. Further, the structure may be made such that an air cooler for cooling an operating air compressed in the compressor main body is provided in a downstream side of the compressor main body, a check valve is provided in a further downstream portion of the air cooler, an air discharging pipe passage diverging from an upstream side of the check valve and having an air discharging cooler and an aid discharging valve is provided, and an air discharging valve control apparatus which closes the air discharging valve at a time of starting the compressor main body and operating it under no load and opens the air discharging valve at a time of operating it under a load is provided.

Accordingly, the following effects can be obtained.

(1) A speed increasing apparatus such as a speed increasing gear, a belt and the like is not required, so that it is possible to make the oil free screw compressor unit compact, light and inexpensive.

(2) A capacity control apparatus for the suction throttling valve, the three way electromagnetic valve and the like is not required, so that it is possible to make the structure of the oil free screw compressor unit simple and inexpensive.

(3) Since it is possible to employ the rotating system conventionally having a high reliability to the electric motor system and the compressor main body system by making an oscillation mechanical structure common between the electric motor system and the compressor main body system, it is possible to provide an oil free screw compressor unit capable of stably rotating to a high speed range.

(4) It is possible to make the oil free screw compressor inexpensive and improve a reliability by making parts common between the electric motor system and the compressor main body system.

DETAILED DESCRIPTION OF THE PREFERRED EMBODIMENTS

Figure 1:
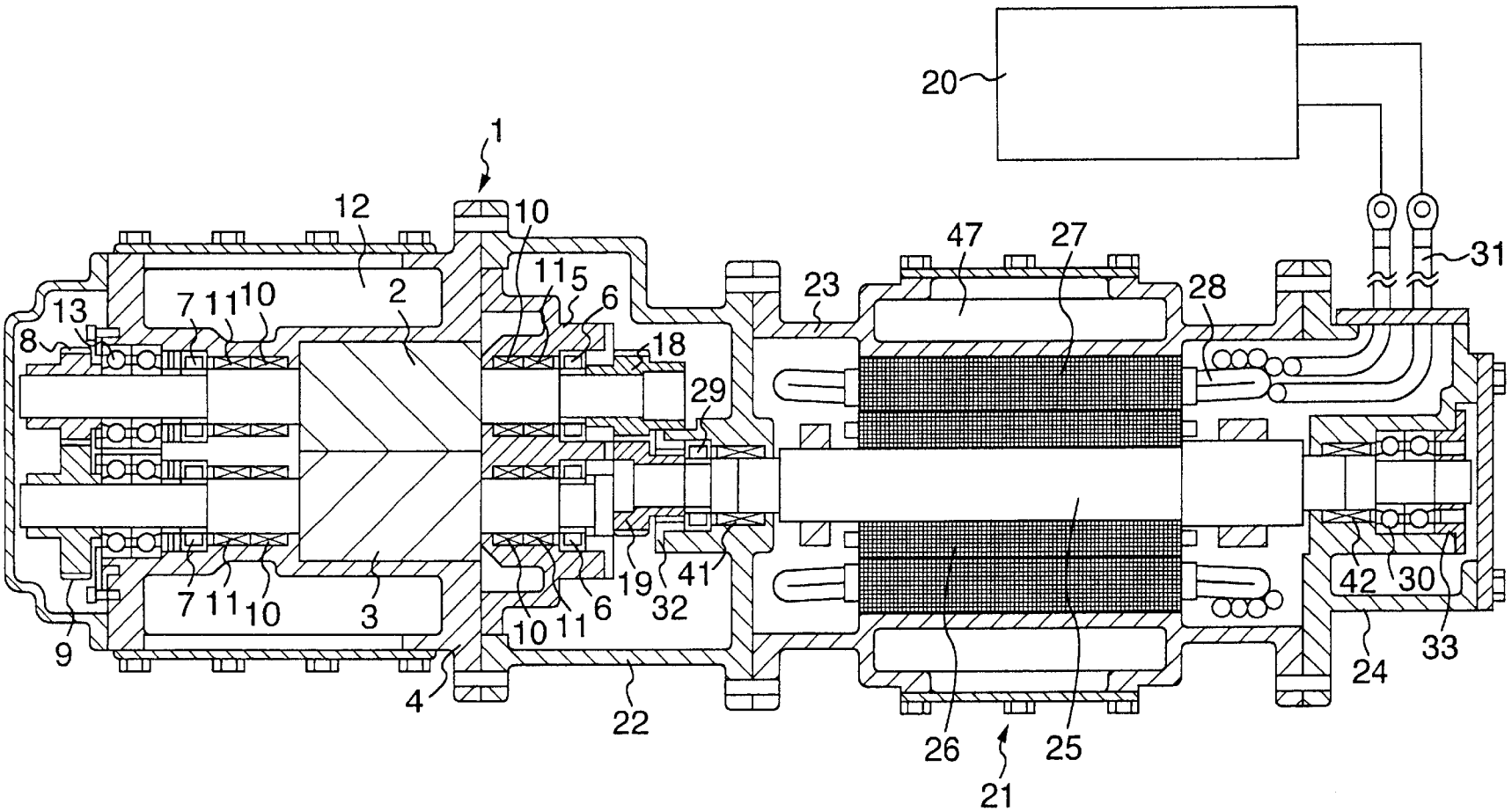
FIG. 1 is a top vertical cross sectional view which shows an embodiment of an oil free screw compressor in accordance with the present invention.
Figure 2:
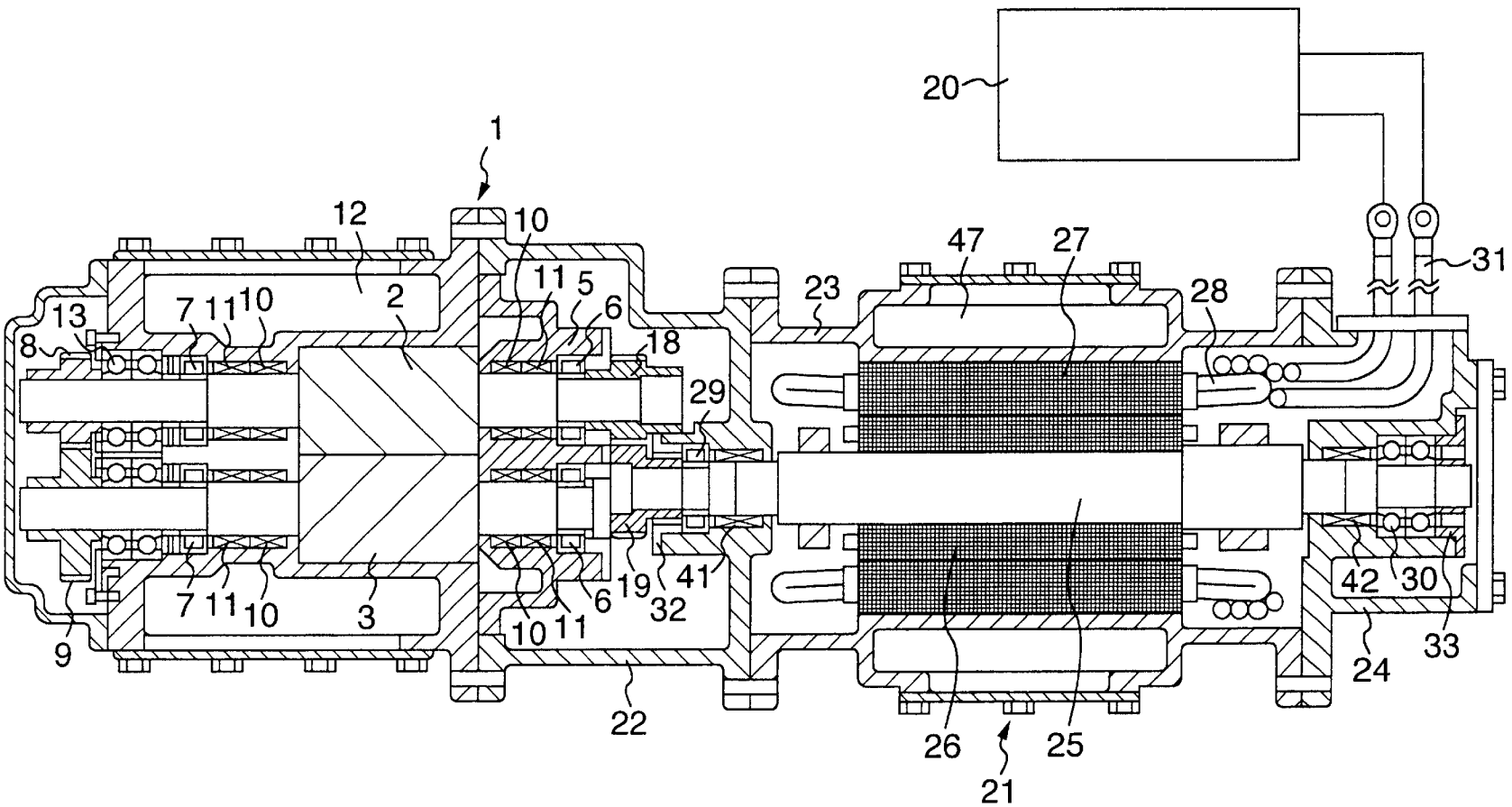
FIG. 2 is a front vertical cross sectional view which shows the embodiment of the oil free screw compressor in accordance with the present invention.
Figure 3:
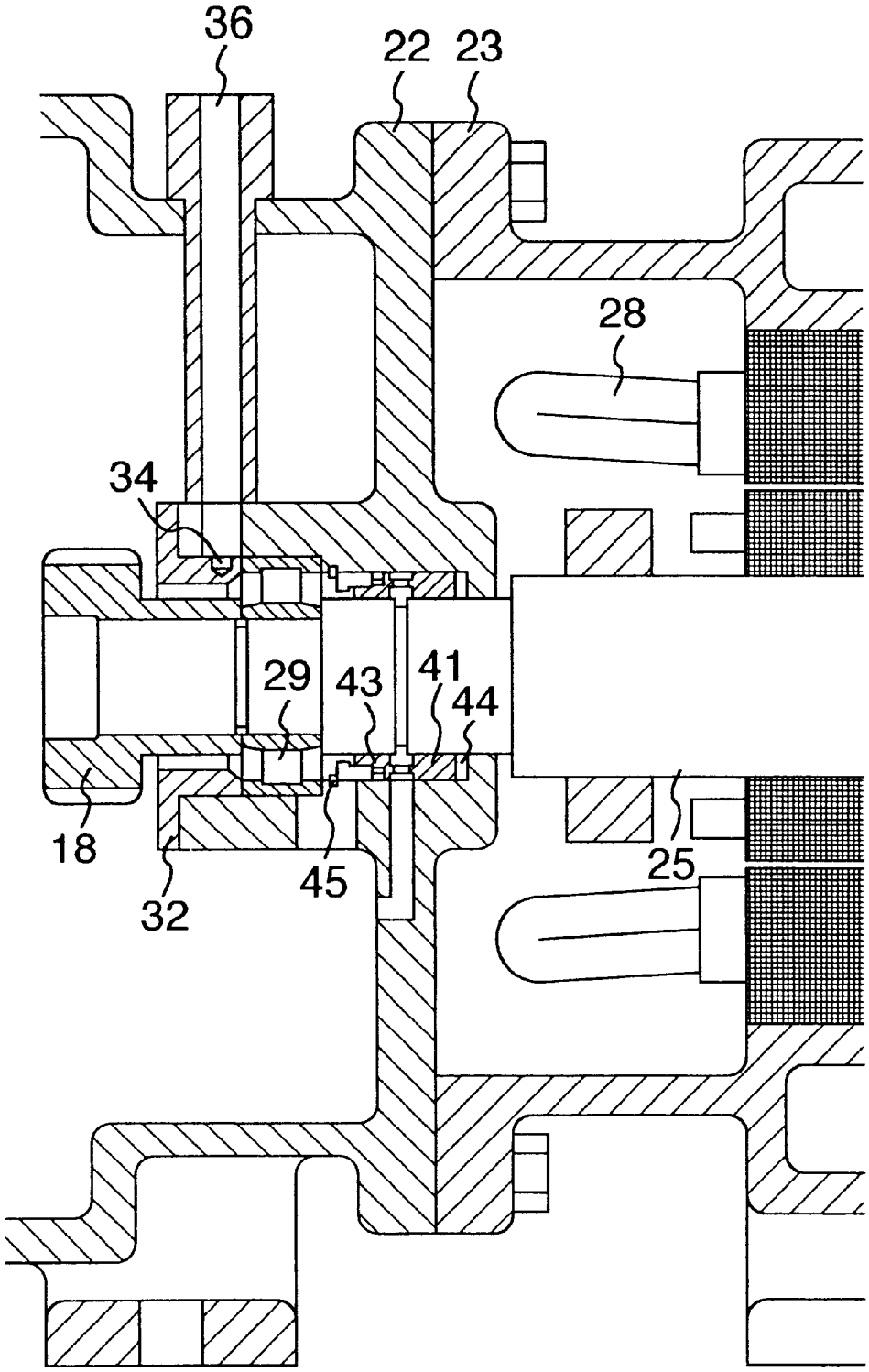
FIG. 3 is a vertical cross sectional view which shows details near a bearing portion in a load side in FIG. 1.
Figure 4:
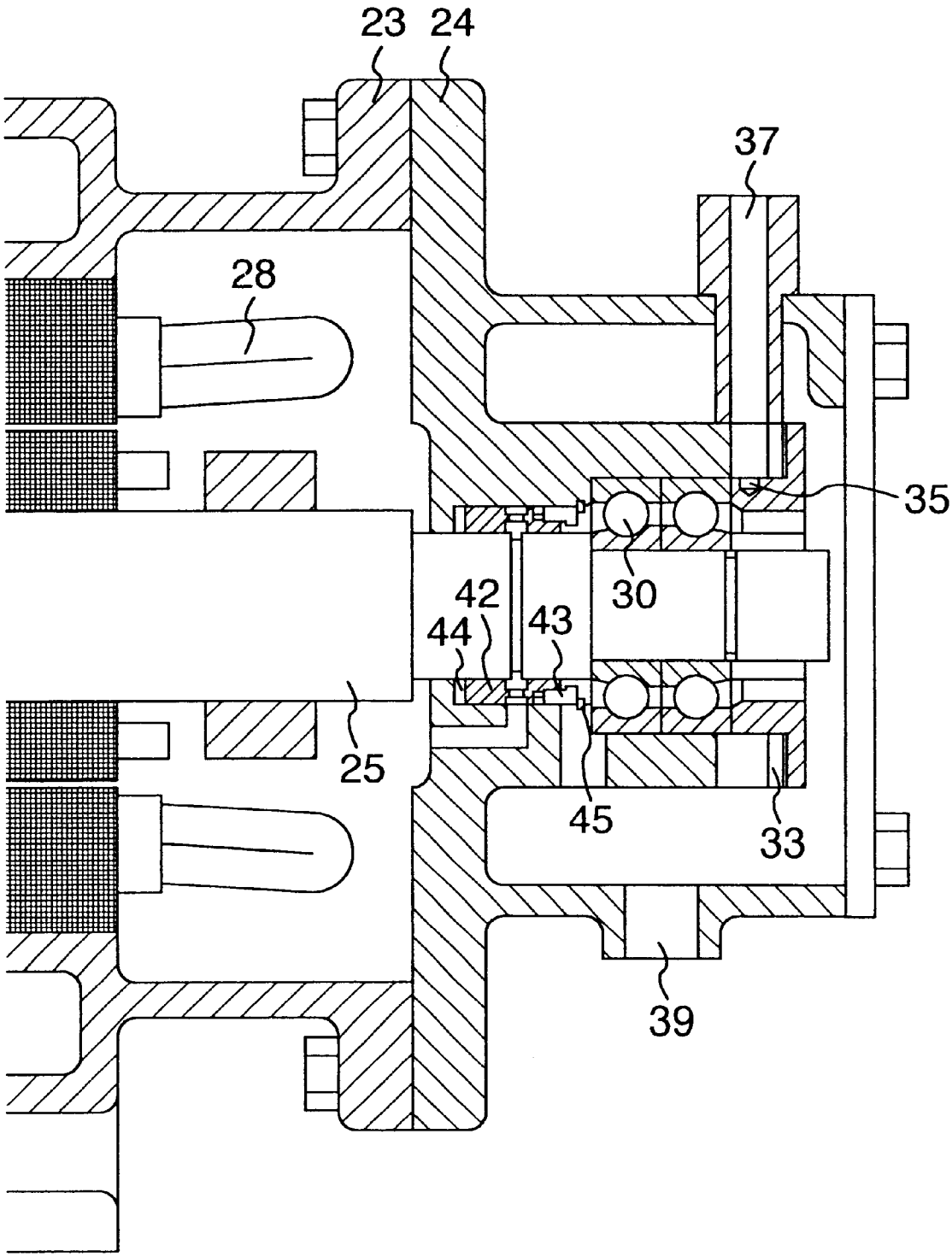
FIG. 4 is a vertical cross sectional view which shows details near a bearing portion in an opposite load side in FIG. 1.

An embodiment of the present invention will be described below with reference to FIGS. 1 to 4. FIG. 1 is a view which shows a top elevational view of an oil free screw compressor driven by a high speed motor in accordance with the present invention by a cross section, FIG. 2 is a view which shows a front elevational view by a cross section, and FIGS. 3 and 4 are vertical cross sectional views which show details of a supporting portion in a motor shaft. A compressor main body 1 is structured such that tooth groove portions of a pair of male rotor 2 and female rotor meshing with each other is received in a casing 4 and drive sides thereof are received in a suction side casing 5, respectively. Then, the male rotor 2 and the female rotor 3 are rotatably supported by a suction side bearing 6 and a discharge side bearing 7 in which a lubricating oil is forcibly lubricated. In this case, a cylindrical roller bearing is employed in the suction side bearing 6, and an angular ball bearing is employed in the discharge side bearing 7 in combination with the cylindrical roller bearing.

A pair of timing gears 8 and 9 are fitted to the discharge side shaft ends of the male rotor 2 and the female rotor 3, thereby synchronously rotating the tooth groove portions of the male rotor 2 and the female rotor 3. A shaft sealing apparatus is provided between the suction side bearing 6 and the discharge side bearing 7 and between the tooth gear portions of the male rotor 2 and the female rotor 3. The shaft sealing apparatus is provided with an air seal 10 for preventing an air from leaking from a compression chamber formed by the tooth gear portions of the male rotor 2 and the female rotor 3 and the casing 4 as much as possible, and a screw seal 11 called as a viscous seal for preventing a lubricating oil supplied to the bearing portion from entering to the compression chamber.

A cooling jacket 12 is provided in an outer peripheral portion of the casing 4, and a liquid refrigerant such as a cooling water, a coolant or the like is supplied thereto. A part of heat generated within the compressor main body 1 exchanges heat with the supplied cooling water or liquid refrigerant and heated to be discharged outward.

A high speed motor 21 is provided with a motor shaft 25 in which a rotor core 26 is mounted at a center portion, a load side bearing 29 rotatably supporting portions near both end portions of the motor shaft, and an opposite load side bearing 30. Further, in opposite to the rotor core 26, a stator core 27 around which a stator coil 28 is wound is held to the motor casing 23. A load side bearing cover 22 which holds the load side bearing 29 for supporting the motor shaft 25 and constituting a casing together with the motor casing 23 is provided at an end portion of the load side shaft. In the same manner, an opposite load side bearing cover 24 which holds the opposite load side bearing 30 for supporting the motor shaft 25 and constituting a casing together with the motor casing 23 is provided at an end portion of the opposite load side shaft. In this case, an outlet portion (not shown) for taking out a lead wire 31 of the stator coil 28 is formed in the opposite load side bearing cover 24.

A cylindrical roller bearing for supporting a radial load is employed for the load side bearing 29, and a combined angular ball bearing capable of supporting both of the radial load and a thrust load is employed for the opposite load side bearing 30. A size of each of the bearings is set to be equal to that of the compressor main body. Further, the load side bearing 29 and the opposite load side bearing 30 are fixed by bearing keepers 32 and 33 after being fitted to the covers 22 and 24 on the outer peripheral surface. Oil supply holes 34 and 35 are formed in the bearing keepers 32 and 33.

A shaft sealing apparatus for preventing a lubricating oil from entering to the stator coil side is provided between the load side bearing 29 and the rotor core 26 and between the opposite load side bearing 30 and the rotor core 26. The shaft sealing apparatus is, as shown in FIGS. 3 and 4 in a detailed manner, provided with viscous seals 41 and 42, a corrugated spring 44 for pressing the viscous seals 41 and 42, and a seal keeper 43 for holding the viscous seals 41 and 42 in the covers 22 and 24 via a stopper ring 45. The viscous seals 41 and 42 have a fine gap with respect to the motor shaft 25 in an internal diameter side. Further, a screw seal having a rectangular screw shaped groove portion is formed in the inner diameter side of the viscous seals 41 and 42. Further, in an outer peripheral portion of the motor casing 23, in order to radiate a heat generated in the high speed motor, a motor side cooling jacket 47 is provided, and a liquid coolant such as a cooling water, a coolant or the like is supplied to the cooling jacket.

A motor side flange 46 is formed at the end portion in the side of the compressor main body of the load side bearing cover 22, and is fastened by a flange 16 formed in the casing 4 and a bolt. A drive side gear 19 is fitted to the shaft end in the load side of the motor shaft 25, and a driven side gear 18 is fitted to the shaft end in the suction side of the male rotor 2. Numbers of the teeth in both of the gears 18 and 19 are equal to each other, and a speed increasing ratio is 1. The lead wire 31 of the high speed motor is connected to the high frequency inverter 20.

When energizing the high frequency inverter 20, an electric power is supplied to the side of the high speed motor 21. As a result, a rotational force generated in the motor shaft 25 is transmitted to the male rotor 2 via a pair of gears 18 and 19, and an air is compressed by a meshing between the rotor tooth groove portions in the respective rotors.

A lubricating oil is introduced to the oil supply holes 34 and 35 from an oil pump (not shown) via oil supply nozzles 36 and 37, and jet injected to an inner portion of the bearing from the oil supply holes 34 and 35. The lubricating oil after lubricating and cooling the bearing is discharged out of the machine from the oil discharge holes 38 and 39, and is finally recovered in an oil reserving apparatus. The lubricating oil passes between an inner ring and an outer ring at a time of lubricating the bearing. Thereafter, the lubricating oil discharged from the bearing flows into the viscous seals 41 and 42, however, a pressure is generated in a groove portion in the side of the inner diameter of the viscous seal when the motor shaft 25 rotates, thereby returning the lubricating oil to the respective bearing sides. As a result, it is possible to prevent the oil from entering to the side of the motor coil 28.

The stator core 27 and the stator coil 28 within the high speed motor 21 generates heat in accordance with an electric loss such as an iron loss, a copper loss and the like. It is possible to cool the motor 21 by exchanging heat between the motor 21 having a temperature increased in accordance with the heat generation and a liquid refrigerant such as a cooling water supplied to the cooling jacket 47 provided in the motor casing 23.

The oil free screw compressor is structured such that a diameter of the male rotor is about 90 mm and a number of rotation is about 20000 rpm in the case of a single stage type, an output of 55 kW class and a discharge pressure of 7 $kgf/cm^2$. When setting the gear ratio between the drive gear and the driven gear to one to one, a set frequency of the high frequency inverter becomes about 330 Hz if a number of the poles in the high speed motor is two.

In this case, in accordance with the present embodiment, in order to realize a commonness of the parts and a stable high speed rotation, the side of the compressor main body and the side of the high speed motor are made in substantially the same structure in view of an oscillation mechanics. That is, the compressor main body and the electric motor are connected to each other by a gear provided at the shaft end of the rotational shafts, however, when considering the shaft separated at this portion, the structure of motor shaft and the female rotor shaft and the supporting portions for the male rotor shaft are made in a similar structure. Concretely speaking, bearings 13 and 30 for supporting the respective shafts are made of the same module type, and the bearings 6, 7 and 29 are made of the same module type. Further, the viscous seals 11 and 24 are formed in the same shape. Still further, a method of supplying an oil to the bearing is performed by a spray lubrication, and they coincide with each other in view of providing the cooling jacket in the outer peripheral side of the motor and the outer peripheral side of the compressor main body.

In this case, since the compressor main body is connected to the high speed motor by the gear having a speed increasing ratio of one to one, that is, an equal speed, a number of rotation in a specification of the compressor can be obtained as it is when increasing the high speed motor to the number of rotation in the specification of the compressor by the high frequency inverter. Therefore, in accordance with the present invention, none of the speed increasing apparatuses is required. Since the high speed motor is used at a range of the great number of rotation, the required motor torque becomes small. Accordingly, the stator core and the stator coil are made compact. As mentioned above, when connecting the compressor main body to the high speed motor at a speed increasing ratio of one to one, it is possible to make a size of a whole of the drive system for driving the compressor small, so that it is possible to make the compressor unit compact and inexpensive.

In this case, in accordance with the present embodiment, the high speed motor and the compressor main body are connected to each other at a speed increasing ratio of one to one, however, the speed increasing ratio is not limited to this, and the effect of the present invention can be obtained since it is not necessary to make the size of the motor and the size of the gear used for reducing and increasing the speed very large as far as the ratio is within the range between the speed increasing ratio of two to one and the speed reducing ratio of about one to two. In this case, the motor can be made compact when the speed increasing ratio is increased, however, the size of the speed increasing apparatus and the cost required for the speed increasing apparatus are increased, so that it is not preferable. On the other hand, it is considered to increase the number of rotation of the motor so as to employ the speed reducing apparatus, however, it is hard to make the motor high speed, so that it is not practical. Further, in accordance with the present embodiment, the motor shaft and the rotational shaft of the male rotor are connected by using the gear, however, it is needless to say that it may be a uniform coupling such as a gear coupling and a diaphragm coupling, or uniform coupling means such as a combination of a spline and a spline coupling.

Figure 5:
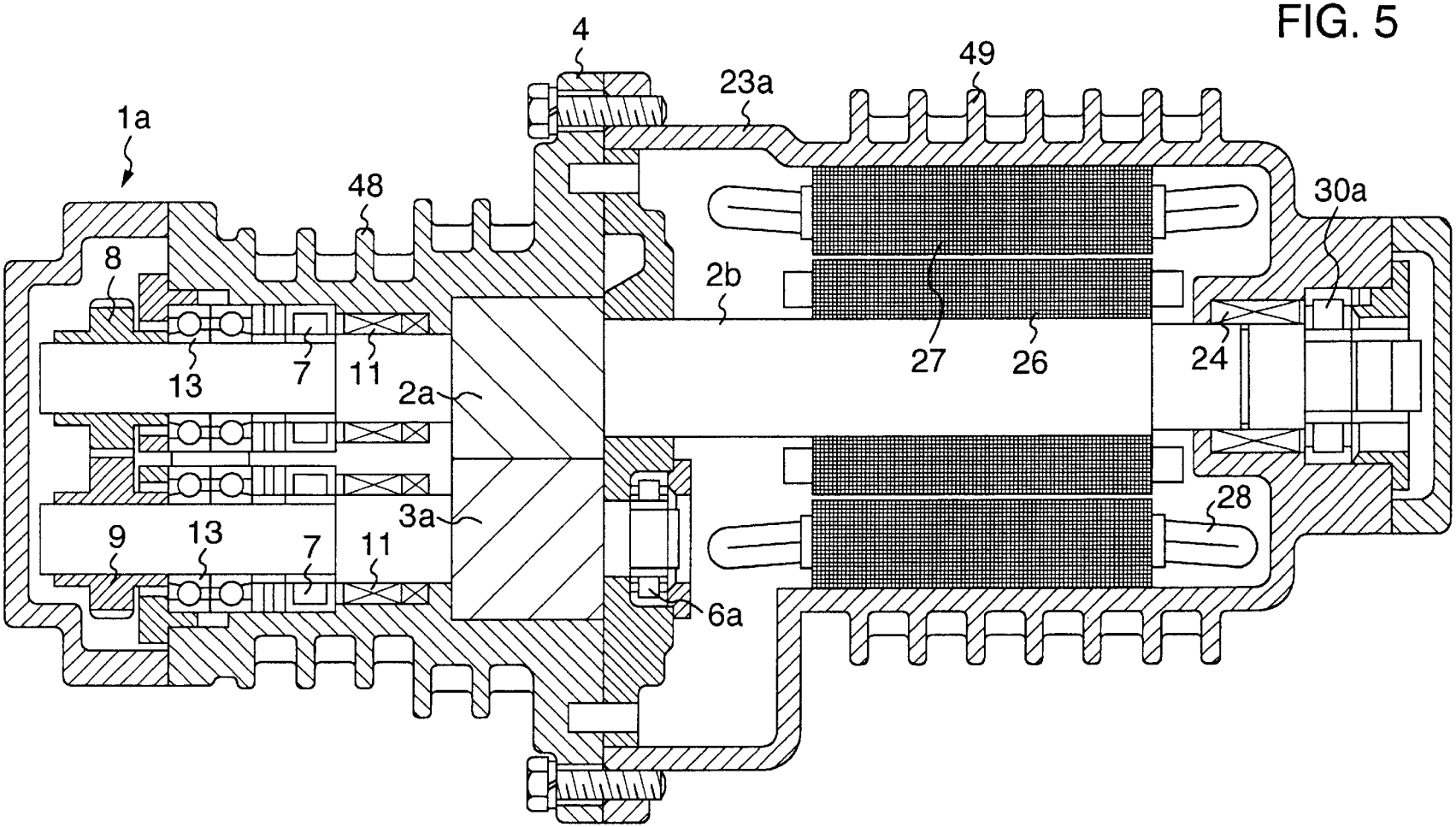
FIG. 5 is a top vertical cross sectional view which shows another embodiment of an oil free screw compressor in accordance with the present invention.

Next, another embodiment in accordance with the present invention will be described below with reference to FIG. 5. In the case that parts shown in FIG. 5 and the parts shown in the embodiment mentioned above are the same, the same reference numerals are attached. A point at which the present embodiment is different from the embodiment shown in FIG. 1 is that a structure that the shaft of the male rotor 2 in the compressor main body 1 and the motor shaft of the high speed motor 21 are integrally formed. In other words, a compressor main body 1*a* and each of parts in the side of the high speed motor except a structure of connecting the male rotor shaft to the rotational shaft of the high speed motor are basically the same as those of the embodiment mentioned above.

The stator core 27 and the stator coil 28 are mounted to a motor casing 23*a*. The rotor core 26 of the high speed motor is mounted to a suction side shaft portion 2*b* of a male rotor 2*a* having a male tooth shape formed in a middle portion. The male rotor 2*a* is rotatably supported by the discharge side bearings 7 and 13 in the side close to the shaft end from the male tooth portion and by an opposite load side bearing 30*a* in the side further closer to the end portion from the rotor core 26. A female rotor 3*a* is supported in the same manner as that of the male rotor 2*a* by the discharge side bearings 7 and 13 in the discharge side and by a suction side bearing 6*a* in the suction side. However, as is different from the embodiment mentioned above, the gear is not mounted to the suction side end portion. A cylindrical roller bearing and a combined angular bearing are employed for the suction side bearings 7 and 13 of the male rotor and the female rotor, and a grease lubricating type roller bearing 6*a* is employed for the suction side bearing 6*a* in the side of the female rotor. As a cooling structure for radiating a heat generated in the compressor main body and the high speed motor, a heat radiating fins 48 and 49 are respectively formed on an outer peripheral portion of the casing 2 and an outer peripheral portion of the motor casing 23.

In the present embodiment structured in this manner, in comparison with the preceding embodiment, the suction side bearing and the shaft sealing apparatus in the male rotor side, the load side bearing and the shaft sealing apparatus in the high speed motor side, and the gear transmitting the power of the high speed motor are not required, it is possible to make the drive system apparatus including the compressor main body compact and inexpensive. Here in the present embodiment, the shaft of the male rotor is commonly used with the motor shaft, however, it is needless to say that the shaft of the female rotor can be commonly used with the motor shaft.

Figure 6:
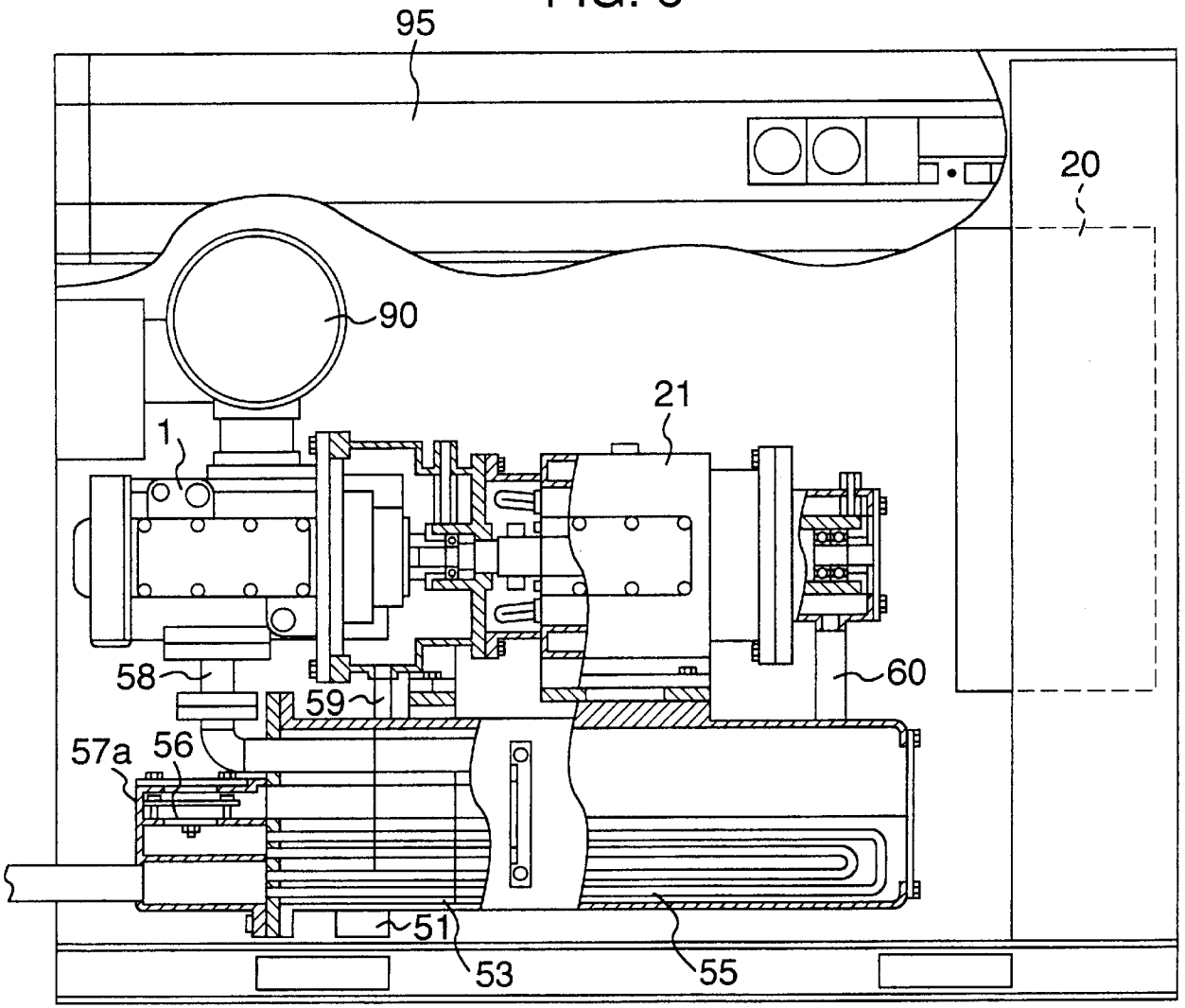
FIG. 6 is a front elevational view which shows a state of packaging the oil free screw compressor in accordance with the present invention.
Figure 7:
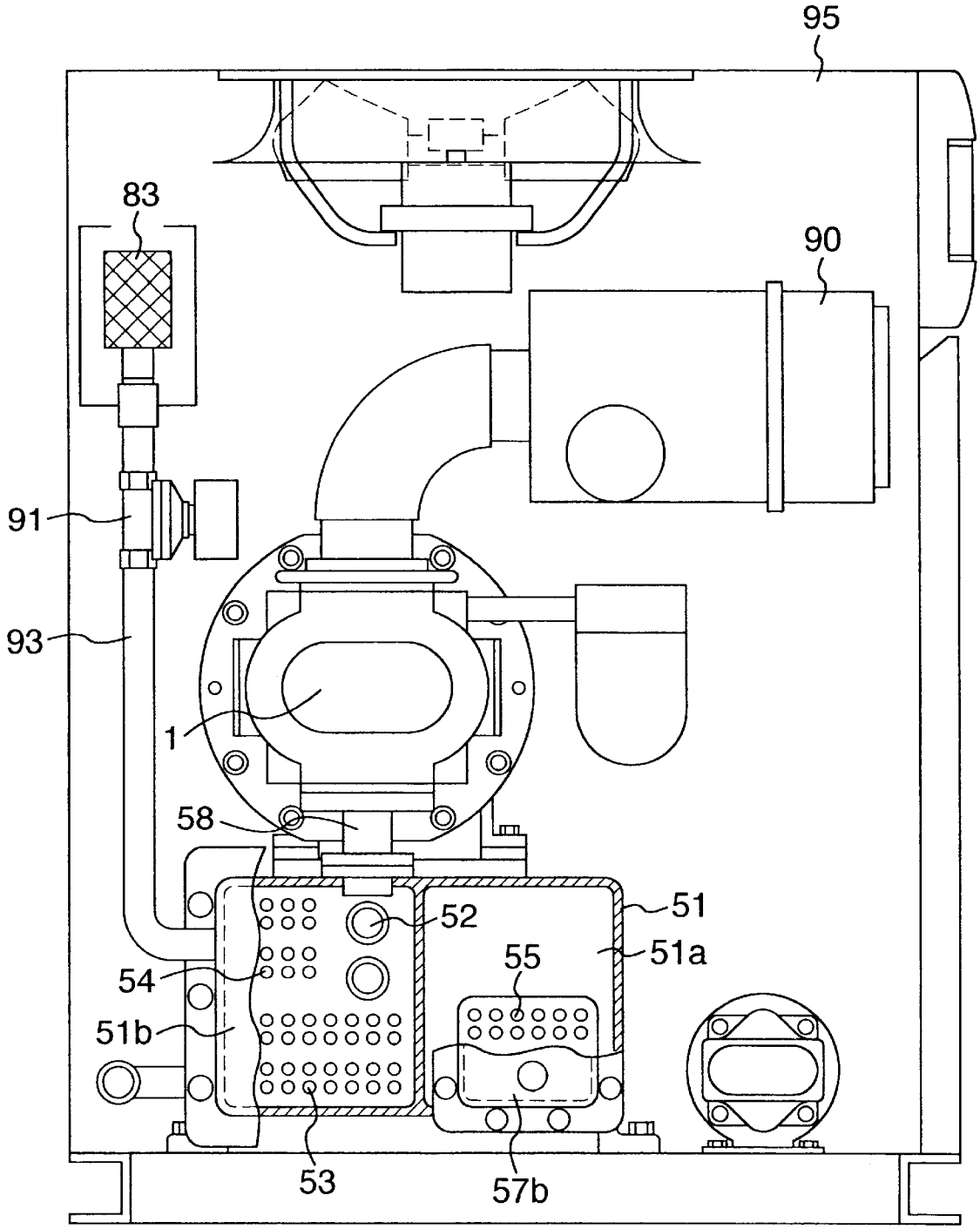
FIG. 7 is a side elevational view of FIG. 6, which partly shows by a cross section.

Next, a description will be given of a state of arranging the oil free screw compressor having the compressor main body and the electric motor integrally formed and described in any one of the embodiments mentioned above within a package, with reference to FIGS. 6 and 7. After integrating the compressor main body with the high speed motor, the integrally assembled product is arranged above a main body table 51 commonly serving as a cooling device. Two chambers are formed by parting the main body table 51. A first chamber 51*a* corresponds to a chamber for receiving a cooling device of a compressed air, and receives a pre-cooler 52 for primarily cooling an air, an after cooler 53 for secondarily cooling an air and a discharged air cooler 54 for cooling a discharged air at a time of unloading. A second chamber 51*b* corresponds to a chamber used as an oil reservoir, and receives an oil cooler 55 for cooling a lubricating oil.

The pre-cooler 52, the after cooler 53 and the discharged air cooler 54 are provided with U-shaped cooling pipes, and a cooling water is passed through an outer side of each of the pipes. On the other hand, the oil cooler 55 is also provided with a U-shaped cooling pipe, and a lubricating oil is introduced to an outer side of the pipe. A header 57*a* in which a check valve 56 is mounted is provided on a side surface of the first chamber 51*a* in the main body table, and a cooling water header 57*b* having cooling water inlet and outlet ports is provided on a side surface of the second chamber 51*b*. The compressor main body 1 and the pre-cooler 52 are connected to each other by a discharge pipe 58, and oil discharge ports 35 and 36 of the high speed motor 21 and the oil cooler 55 are connected to each other by oil discharge pipes 59 and 60. In this case, a suction filter 90 is mounted to the suction side of the compressor main body 1, and an air discharge pipe 98 having an air discharge valve 91 interposed is mounted to the discharge side. An air discharge silencer 83 is mounted to a front end portion of the air discharge pipe. Then, the main body table 51, the compressor main body 1, the high speed motor 21 and the suction and outlet pipe systems are received within a casing 95 so as to constitute a package type oil free screw compressor.

It is possible to shorten a length of the pipe connecting between the integrally assembled product and each of the coolers by integrally assembling the compressor main body and the high speed motor and arranging the integrally assembled product immediately above the main body table for receiving the pre-cooler, the after cooler and the like, and it is possible to reduce a wasteful space within the compressor package and make the compressor unit compact and light by making a longitudinal size of the main body table substantially equal to a longitudinal size of the integrally assembled product.

Figure 8:
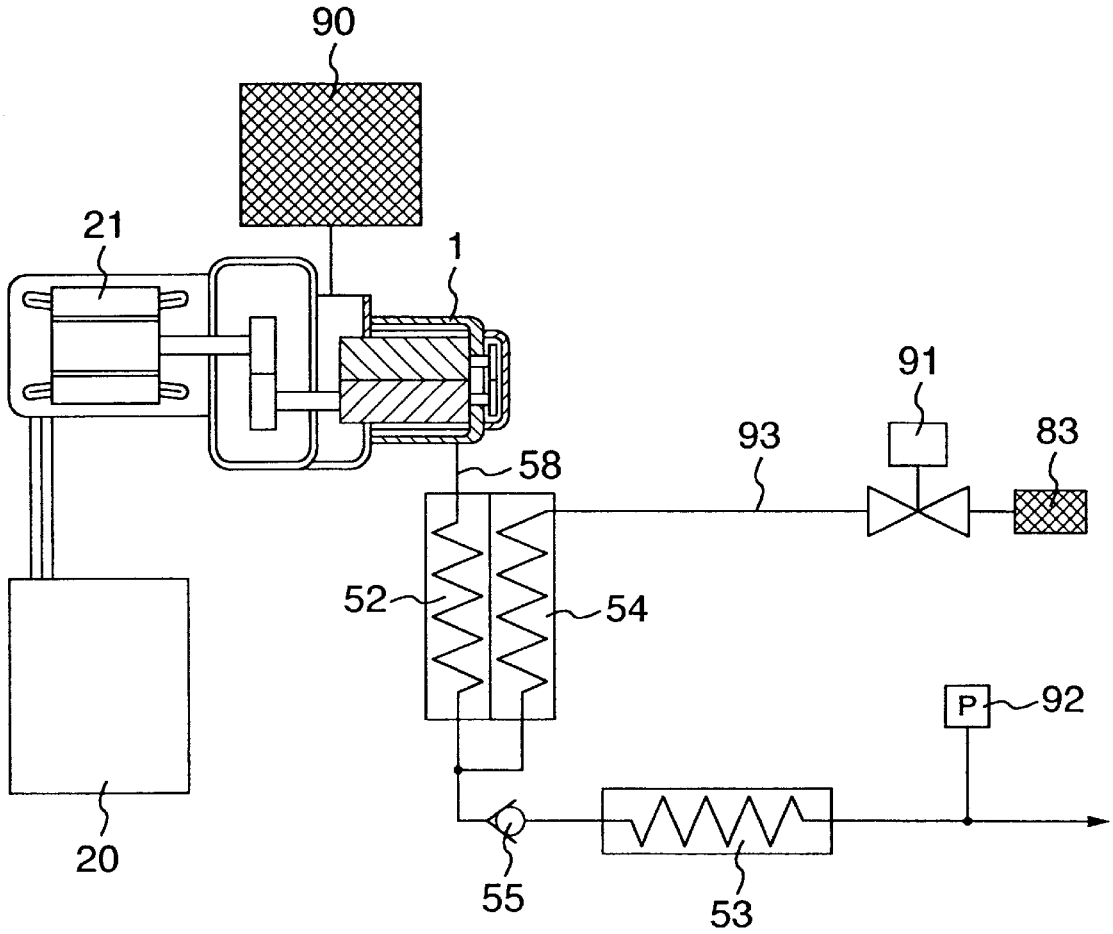
FIG. 8 is a systematic view of a compressed air of an oil free screw compressor in accordance with the present invention.

Next, a description will be given of a case of controlling a number of rotation in the oil free screw compressor described in the embodiments shown in FIG. 1 or FIG. 5 by using an inverter, with reference to FIG. 8. In the conventional oil free compressor, an unload assembled product is arranged in the suction side of the compressor main body. The unload assembled product has an air cylinder, a suction throttling valve, an air discharging valve, an unload body and the like.

On the other hand, in accordance with the present invention, a capacity control apparatus is not provided in the suction side of the compressor, but the suction filter is directly arranged therein. Further, the compressor main body 1, the pre-cooler 52 for primarily cooling the compressed air having a high temperature, the check valve 55 and the after cooler 53 for secondarily cooling the compressed air having a high temperature are successively connected by the discharge pipe 58. Then, the air discharge pipe 93 is arranged in a primary side of the check valve 55 and a secondary side of the pre-cooler, and the air discharge electro-magnetic valve 91 is provided in the air discharge pipe 93. An operation of the air discharge valve 91 is changed in accordance with an operating state of the compressor and a number of rotation of the compressor main body. The operating state is shown in Table 1.

TABLE 1

| Operating state compressor | Number of rotation of compressor main body | Air discharge valve |
|---|---|---|
| Starting time | 0 → 20000 rpm | Open |
| Loading time | 10000 ←→20000 rpm | Close |
| Unloading time | 10000 rpm constant | Open |

Here, in this case, a maximum used number of rotation of the compressor main body is set to 20000 rpm, and a half thereof, i.e. 10000 rpm, is set to an unloading time number of rotation, that is, a lower limit number of rotation.

At a time of starting, the compressor main body is accelerated to the maximum number of rotation by a control apparatus (not shown). At this time, when opening the air discharge valve 91, the compressed air is discharged and the discharge pressure is reduced, so that it is possible to reduce a load in the side of the inverter. At a time of loading, a pressure sensor 92 detects an increase or reduction of an amount of a used air in a side of a demand line, and the inverter controls the number of rotation of the compressor main body so that the pressure at the outlet of the compressor unit detected by the pressure sensor 92 becomes constant, whereby an amount of the discharged air is controlled.

When the amount of the used air is reduced in the load state, the control apparatus reduces the number of rotation of the compressor. When the amount of the used air is subsequently reduced, the number of rotation of the compressor reaches the lower limit value 10000 rpm. In this state, when the pressure sensor 92 further detects an increase of the pressure, the control apparatus judges that the compressor is in an unload operating state, so that the control apparatus outputs a command of opening the air discharge valve 91. When opening the air discharge valve 91 so as to discharge the compressed air, the number of rotation of the compressor becomes the lower limit value, the discharge pressure is low and the power of the compressor is small. In this case, in accordance with the present embodiment, the electromagnetic valve which can be electrically opened and closed by the detected pressure of the pressure sensor 92 is employed for the air discharge valve 91, however, the present invention is not limited thereto.

In the present embodiment structured in the manner mentioned above, since the inverter and the air discharge valve are combined, the conventionally used unloading apparatus is not required.

What is claimed is:

1. A screw compressor comprising:

a compressor main body;

a male rotor having a screw-like male tooth shape and a female rotor having a screw-like female tooth shape meshing with the screw-like male tooth shape or the male rotor, the male and female rotors being provided within the compressor main body;

a casing aligned in a longitudinal direction with and operably connected to the compressor main body; and a high speed electric motor provided within the casing, the motor comprising a motor rotor, a motor stator and a motor shaft for driving at least one of the male and female rotors;

wherein a speed ratio of the motor shaft and the at least one of the male and female rotors driven by the motor shaft is in a range of 2:1 to 1:2.

2. The screw compressor according to claim 1, further comprising a cooling jacket provided within the casing to which cooling fluid can be supplied to cool the motor.

3. The screw compressor according to claim 2, further comprising a coupling for coupling the motor shaft and at least one of the male and female rotors.

4. The screw compressor according to claim 3, wherein the coupling comprises a first gear provided in a side of one end of any one of the male rotor and the female rotor, a second gear meshing with the first gear is provided in a side of one end of the motor shaft, and a ratio of a number of teeth between the first gear and the second gear is set to be substantially one to one.

5. The screw compressor according to claim 3, wherein the coupling comprises a first gear provided in a side of one end of any one of the male rotor and the female rotor, a second gear meshing with the first gear is provided in a side of one end of the motor shaft.

6. The screw compressor according to claim 1, further comprising a coupling for coupling the motor shaft and at least one of the male and female rotors.

7. The screw compressor according to claim 1, wherein the coupling comprises a first gear provided in a side of one end of any one of the male rotor and the female rotor, a second gear meshing with the first gear is provided in a side of one end of the motor shaft.

8. The screw compressor according to claim 1, further comprising timing gears connected to the male and female rotors for synchronously rotating the male and female rotors.

9. The screw compressor according to claim 1, wherein the casing comprises a motor casing and bearing covers, and one of said bearing covers is connected to the compressor main body.

10. The screw compressor according to claim 2, wherein the casing comprises a motor casing and bearing covers, and one of said bearing covers is connected to the compressor main body.

11. The screw compressor according to claim 10, wherein the cooling jacket is provided within the motor casing.

12. The screw compressor according to claim 1, wherein the motor shaft and one of the male and female rotors are substantially aligned in an axial direction.

13. The screw compressor according to claim 1, wherein the motor shaft and one of the male and female rotors are coaxial.

14. A screw compressor comprising:

a compressor main body;

a male rotor having a screw-like male tooth shape and a female rotor having a screw-like female tooth shape meshing with the screw-like male tooth shape or the male rotor, the male and female motors being provided within the compressor main body;

a motor casing operably connected to the compressor main body;

a high speed electric motor provided within the motor casing, the motor comprising a motor rotor, a motor stator and a motor shaft for driving at least one of the male and female rotors; and a cooling jacket provided within the motor casing to which cooling fluid can be supplied to cool the motor;

wherein the motor shaft and one of the male and female rotors are integral so that a rotational speed of the motor shaft is equal to the rotational speed of the one of the male and female rotors.

15. A screw compressor comprising:

a compressor main body;

a male rotor having a screw-like male tooth shape and a female rotor having a screw-like female tooth shape meshing with the screw-like male tooth shape or the male rotor, the male and female motors being provided within the compressor main body;

a motor casing operably connected to the compressor main body;

a high speed electric motor provided within the motor casing, the motor comprising a motor rotor, a motor stator and a motor shaft for driving at least one of the male and female rotors;

a cooling jacket provided within the motor casing to which cooling fluid can be supplied to cool the motor; and timing gears connected to the male and female rotors for synchronously rotating the male and female rotors wherein a speed ratio of the motor shaft and the at least one of the male and female rotors driven by the motor shaft is in a range of 2:1 to 1:2.

16. A screw compressor comprising:

a compressor main body;

a male rotor having a screw-like male tooth shape and a female rotor having a screw-like female tooth shape meshing with the screw-like male tooth shape or the male rotor, the male and female motors being provided within the compressor main body;

a motor casing operably connected to the compressor main body;

a high speed electric motor provided within the motor casing, the motor comprising a motor rotor, a motor stator and a motor shaft for driving at least one of the male and female rotors;

a cooling jacket provided within the motor casing to which cooling fluid can be supplied to cool the motor; and a high frequency inverter connected to the motor for driving the motor wherein a speed ratio of the motor shaft and the at least one of the male and female rotors driven by the motor shaft is in a range of 2:1 to 1:2.

17. A screw compressor comprising:

a compressor main body;

a male rotor having a screw-like male tooth shape and a female rotor having a screw-like female tooth shape meshing with the screw-like male tooth shape or the male rotor, the male and female motors being provided within the compressor main body;

a motor casing operably connected to the compressor main body;

a high speed electric motor provided within the motor casing, the motor comprising a motor rotor, a motor stator and a motor shaft for driving at least one of the male and female rotors;

a cooling jacket provided within the motor casing to which cooling fluid can be supplied to cool the motor; and a high frequency inverter connected to the motor for driving the motor wherein a speed ratio of the motor shaft and the at least one of the male and female rotors driven by the motor shaft is in a range of 2:1 to 1:2.

* * * * *